US007128751B2

(12) United States Patent
Reil

(10) Patent No.: US 7,128,751 B2
(45) Date of Patent: Oct. 31, 2006

(54) EAR PIERCING SYSTEMS WITH HINGED HOOP EARRINGS

(76) Inventor: Vladimir Reil, 521 W. Rosecrans Ave., Los Angeles, CA (US)

( * ) Notice: Subject to any disclaimer, the term of this patent is extended or adjusted under 35 U.S.C. 154(b) by 84 days.

(21) Appl. No.: 10/863,692

(22) Filed: Jun. 8, 2004

(65) Prior Publication Data

US 2004/0225315 A1 Nov. 11, 2004

Related U.S. Application Data

(60) Continuation of application No. 09/929,508, filed on Aug. 14, 2001, now Pat. No. 6,796,990, which is a division of application No. 09/690,311, filed on Oct. 17, 2000, now Pat. No. 6,599,306.

(51) Int. Cl.
*A61B 17/00* (2006.01)

(52) U.S. Cl. ..... 606/188; 606/185; 63/13

(58) Field of Classification Search ..... 606/188, 606/116, 113; 63/13; 40/301
See application file for complete search history.

(56) References Cited

U.S. PATENT DOCUMENTS

| | | | | |
|---|---|---|---|---|
| 3,930,576 | A * | 1/1976 | Stephens | 206/749 |
| 3,945,089 | A | 3/1976 | Gagnon | |
| 4,030,507 | A * | 6/1977 | Mann | 606/188 |
| 4,146,032 | A | 3/1979 | Rubenstein et al. | |
| 4,184,343 | A | 1/1980 | Green | |
| 4,195,492 | A | 4/1980 | Johnson | |
| 4,214,456 | A | 7/1980 | Hannum | |
| 4,259,850 | A | 4/1981 | Lalieu | |
| 4,372,131 | A * | 2/1983 | Musillo | 63/12 |
| 4,397,067 | A | 8/1983 | Rapseik | |
| 4,527,563 | A * | 7/1985 | Reil | 606/188 |
| 4,631,929 | A | 12/1986 | Hollingworth | |
| 4,635,389 | A * | 1/1987 | Oudelette | 40/301 |
| 4,739,878 | A * | 4/1988 | DiDomenico | 206/6.1 |
| 4,907,425 | A | 3/1990 | Elkin | |
| 5,004,471 | A | 4/1991 | Mann | |
| 5,140,840 | A | 8/1992 | Miceli | |
| 5,154,068 | A | 10/1992 | DiDomenico | |
| 5,201,197 | A | 4/1993 | Bakker | |
| 5,263,960 | A * | 11/1993 | Mann | 606/188 |
| 5,389,105 | A * | 2/1995 | Mann | 606/188 |
| 5,454,829 | A | 10/1995 | Koland | |
| 5,456,094 | A | 10/1995 | Greenwald | |
| D366,316 | S | 1/1996 | Reil | |
| 5,496,343 | A | 3/1996 | Reil | |

(Continued)

FOREIGN PATENT DOCUMENTS

| | | |
|---|---|---|
| JP | 08196313 | 8/1996 |

(Continued)

OTHER PUBLICATIONS

International Search Report for PCT/US 01/42754.

*Primary Examiner*—(Jackie) Tan-Uyen Ho
*Assistant Examiner*—Natalie Pous
(74) *Attorney, Agent, or Firm*—Canady & Lortz LLP

(57) ABSTRACT

A system for providing safe, effective ear-piercing is provided. A hinged hoop earring is provided for use in a stud gun system. The hinged hoop earring can be used in an earring cartridge which fits in a cradle of a stud gun for piercing. A vertically stackable packing box maintains a sterile environment in which the earring cartridge with a hinged hoop earring may be transported and stored. The stud gun can be loaded and unloaded using the packing box in such a way that the operator need not touch the cartridge during either loading or unloading.

17 Claims, 11 Drawing Sheets

U.S. PATENT DOCUMENTS

| | | | | | |
|---|---|---|---|---|---|
| 5,499,993 | A | | 3/1996 | Blomdahl et al. | |
| 5,588,309 | A | | 12/1996 | Chioffe | |
| 5,632,163 | A | | 5/1997 | Inoue | |
| D384,302 | S | | 9/1997 | Reil | |
| 5,675,987 | A | | 10/1997 | Nakajima | |
| D392,042 | S | | 3/1998 | Reil | |
| 5,743,113 | A | | 4/1998 | Kogen | |
| 5,761,928 | A | * | 6/1998 | Silveri | 63/12 |
| 5,792,170 | A | | 8/1998 | Reil | |
| 5,816,073 | A | * | 10/1998 | Bardisbanyan | 63/12 |
| 5,836,176 | A | * | 11/1998 | Lichtenstein et al. | 63/13 |
| 5,868,774 | A | | 2/1999 | Reil | |
| 5,913,869 | A | * | 6/1999 | Reil | 606/188 |
| 6,036,712 | A | | 3/2000 | Blomdahl | |
| 6,048,355 | A | * | 4/2000 | Mann et al. | 606/188 |
| 6,074,406 | A | * | 6/2000 | Mann | 606/188 |
| 6,128,923 | A | * | 10/2000 | Brams | 63/12 |
| 6,231,579 | B1 | * | 5/2001 | Castro Netto | 606/116 |
| RE37,937 | E | * | 12/2002 | Mann | 606/188 |
| 6,571,956 | B1 | * | 6/2003 | Mann | 206/581 |
| 6,599,306 | B1 | * | 7/2003 | Reil | 606/188 |
| 6,796,990 | B1 | * | 9/2004 | Reil | 606/188 |
| 2002/0084207 | A1 | * | 7/2002 | Mann | 206/581 |
| 2005/0120744 | A1 | * | 6/2005 | Kim | 63/12 |

FOREIGN PATENT DOCUMENTS

| | | |
|---|---|---|
| JP | 08322615 | 12/1996 |
| JP | 09224722 | 9/1997 |

* cited by examiner

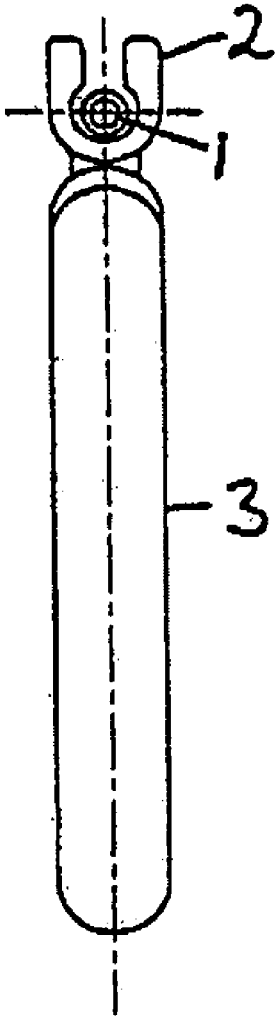
FIG. 1C
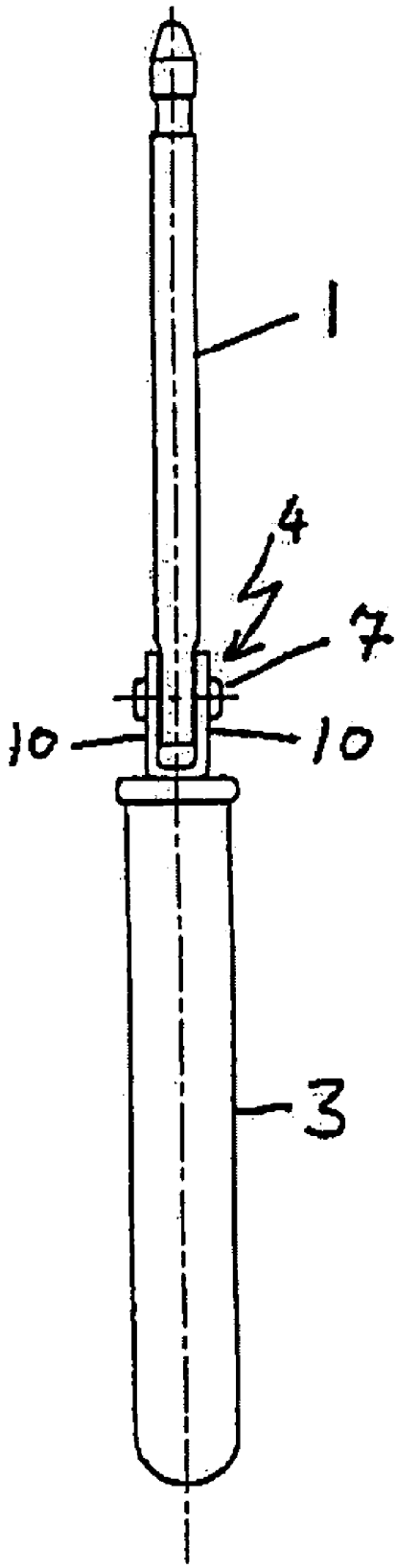
FIG 1.D

EAR PIERCING SYSTEMS WITH HINGED HOOP EARRINGS

CROSS-REFERENCE TO RELATED APPLICATIONS

This application is a continuation application and claims the benefit under 35 U.S.C. §120 of the following U.S. patent application, which is incorporated by reference herein:

Application Ser. No. 09/929,508, filed Aug. 14, 2001 now U.S. Pat. No. 6,796,990, by Vladimir Reil, entitled "EAR PIERCING SYSTEMS WITH HINGED HOOP EARRINGS," which is a continuation-in-part of application Ser. No. 09/690,311 filed on Oct. 17, 2000 now U.S. Pat. No. 6,599,306.

BACKGROUND OF THE INVENTION

1. Field of the Invention

This invention relates to ear-piercing devices and, more particularly, to an ear-piercing cartridge and stud gun system with a stackable packing box for the cartridge.

2. Description of the Related Art

Ear piercing, an increasingly commonplace fashion statement, is rapidly becoming a routine procedures, often performed by laypersons without medical experience or training. Today a number of manually operated devices that allow for the safe, hygienic, user-friendly piercing of ears are available. Examples of such systems are disclosed in U.S. Pat. No. 5,496,343 issued to Reil on Mar. 5, 1996, Application Ser. No. 292,249 filed Aug. 18, 1994, U.S. Pat. No. 5,792,170 issued to Reil on Aug. 11, 1998, Application Ser. No. 754,411 filed Nov. 21, 1996, and U.S. Pat. No. 5,868,774 ("the '774 patent") issued to Reil on Feb. 9, 1999, Application Ser. No. 008,763 filed Jan. 19, 1998, all of which are incorporated herein by this reference.

The various ear-piercing systems that exist today essentially comprise a stud (also called an earring or a piercing earring) with a post (also called a pin or a piercing pin) and a nut (sometimes called a clasp or an earring clasp) that are mounted in an earring cartridge. During the ear piercing process, the ear is placed between the post and the nut and the cartridge is squeezed, either manually or by placing it in a stud gun, which causes the post to pierce the ear and engage the nut.

From a fashion standpoint, one of the most desirable earring designs is in the form of a hoop but, heretofore, hoop earrings have not been commonly used with ear-piercing systems. By and large, the studs in use today have designs that are symmetrical about the post. A primitive hoop earring ear-piercing system is disclosed in U.S. Pat. No. 5,004,471 ("the '471 patent") but the disclosed design is not a fully closeable hoop thereby creating an unsightly design. The stud post (or piercing pin) is engaged by the nut (or clasp), leaving the hoop open. This is because the stud post is rigidly attached to the hoop of the stud, which implies that the hoop cannot be rotated to engage the piercing pin. Further, the open end of the hoop is not adapted to engage the piercing pin (or stud). Apart from its untoward appearance, the design disclosed in the '471 patent also poses a danger of scratching and injury to the wearer because of the open end of the hoop. Therefore, there exists a need today for a hoop earring that is fully closeable.

Additionally, the existing designs for earring nuts (or clasps) are such that the open end of the stud post sticks out of the nut after the stud post is engaged by the nut. This presents a potential for injury to the wearer of the earring because the open end of the stud post can scratch the wearer's neck behind the ear. Therefore, there is a need for an improved earring nut that will remove this potential for injury.

Further, the existing ear-piercing cartridges suffer from a number of drawbacks. To illustrate these drawbacks, consider the '774 patent, which represents the state-of-the-art in earpiercing design. The '774 patent describes an ear-piercing apparatus that is comprised of an earring cartridge which holds an earring stud and an earring nut in two opposed jaws, i.e., an earring jaw and a nut jaw. The stud is held within a stud post holder assembly (also called "pierced-ear earring cartridge" in the Reil '774 patent), which is a module that disassembles into two pieces. One of these pieces has a frangible and breakable tab at its rear.

Although, the '774 patent describes a simple, easy to use ear-piercing system, when it is used to pierce an ear, the two pieces of the stud post holder assembly may stay attached to the stud and, therefore, sometimes require manual removal from the earring. Even when the two pieces come off the stud, they fall out of the assembly, sometimes into the ear or onto the body of the subject whose ears are being pierced and at other times onto the floor.

Moreover, the reliance of the '774 patent on the frangible tab has design limitations. First, the breaking of the tab causes an unwanted noise that is often a source of distress or concern for the customer. Second, the use of the frangible tab leads to only discrete control over the ear-piercing process. In the invention of the '774 patent, when the earring assembly is squeezed, either holding it in a hand or mounted in an ear-piercing gun, the presence of the frangible tab implies that once the earring assembly is squeezed to the point of breaking the tab, the ear is pierced automatically. Thus, it prevents continuous control of the exact location and timing of the ear-piercing process. Because of the lack of continuous control over the location and timing of the ear-piercing process, the technician who is piercing the ear has to use guesswork to line the stud post with the desired piercing area. This causes him to sometimes miss the exact spot that he wanted to pierce.

Additionally, the ear-piercing system of the '774 patent and its predecessors have not been designed for use with the novel hinged hoop earrings described above.

Finally, the '774 patent discloses a sterilizable blister pack for storing and transporting the earring cartridge. While such a packing is a convenient, effective sterilizable packing for the cartridge, it does not provide rigid, vertical stackable storage for earring cartridges.

SUMMARY OF THE INVENTION

The present invention solves the preceding problems, representing a quantum improvement in the design and operation of ear-piercing systems. It provides an improved hoop ear-piercing earring design that is fully closeable and that is hinged to allow for free rotation of the hoop. Further, the invention provides an ingenious earring cartridge system that can be adapted for use with hinged hoop earrings of the present invention as well as with traditional symmetrical ear-piercing earrings and that provides for complete and instantaneous release of the cartridge assembly from the stud and nut once the ear is pierced. Additionally, the earring cartridge of the invention allows the technician to exercise continuous control over the ear-piercing process, thereby allowing him to align the stud post and the location to be pierced right up to the point of piercing. This leads to greatly increased accuracy of the ear-piercing process as compared to the prior art. The invention also provides an improved earring nut for use with the traditional ear-piercing earring, which includes a flat shield for isolating the open end of the stud post from the body of the earring wearer. The improved nut design also ensures correct spacing between the head of the stud and the nut, preventing the nut from traveling too far down the stud post and squeezing the pierced area, which can inhibit healing.

In a general embodiment, the present invention is an earring cartridge and stud gun system for providing sterile ear piercing comprising an earring cartridge carrying a stud having a post in a stud post holder assembly and a nut in slidably aligned, spaced apart, and oppositely opposed placement so that an ear part may be placed between the post and the nut for piercing wherein a torque-like force is produced on the stud post holder assembly causing the assembly to rotatably open after the earring cartridge is compressed to bring the stud towards the nut for engaging the post with the nut. The rotatable opening of the stud post holder assembly facilitates the disengagement of the assembly from the earring stud after the stud has connected to the nut, eliminating the need to touch the ears of the customer to confirm the stud-nut connection or to remove the assembly after the ear piercing is completed.

In a preferred embodiment, the earring cartridge comprises a nut jaw for holding the nut and an earring jaw for holding the stud post holder assembly, which carries the stud. The assembly is in two halves with each half having a front stud head adaptor, a main body and an L-shaped terminal member having a base and a leg. The terminal members ride in inteunediate channels in the earring jaw and, when the earring cartridge is squeezed the main body of the post holder assembly moves relative to the flexible tang, engaging it, and the bases of the terminal members slide over a hump juxtaposed with the tang.

The invention also provides for convenient hygienic transport and storage of the cartridge in the form of a stackable packing box which contains a robust seal to maintain the cartridge in a sterile environment.

If the invention is used with a stud gun, the earring cartridge is used by placement while loading within the cradle of the gun, the cradle receiving and removing the earring cartridge from the stackable packing box to provide and maintain the stud and the nut assembly in an aligned position for piercing the ear without any necessity of coming in direct contact with the sterile earring cartridge with the hands of the operator. After the ear is pierced, the stackable packing box can be used to unload the cartridge from the stud gun. Thus, the packing box allows the operator to load and unload the cartridge from the stud gun without touching the cartridge.

OBJECTS OF THE INVENTION

It is an object of the invention to provide a freely rotatable hinged hoop earring ear-piercing system that is closeable.

It is a further object of the present invention to provide a more effective means by which ears may be pierced. In particular, the present invention seeks to provide an ear-piercing system in which the stud holding module separates from the stud cleanly after the ear is pierced. Further, the present invention provides a system whereby the components of the stud holder module remain within the earring cartridge after an ear is pierced. This eliminates the possibility of the module components falling into the ear or body of the subject being pierced or onto the floor, forcing the ear piercer to look for them following the ear piercing operation.

It is another object of the present invention to provide a higher level of accuracy for ear-piercing by means that are more controllable and more expertly handled by persons without the requirement of a high degree of training. In particular, the present invention seeks to provide an ear-piercing system that can be finely controlled by the ear-piercer whereby the ear-piercer need not commit to piercing an ear until he is certain of piercing the precise spot that he wants to.

Additionally, the invention seeks to provide a safe earring nut for use with traditional style ear-piercing earrings that protects the wearer from being scratched by the open end of the stud post.

It is yet another object of the present invention to provide an ear-piercing methodology that creates, protects and maintains sterile ear-piercing instruments prior to the actual piercing. It is an additional object of the present invention to provide sterilizable and sterile means by which the disposable, one-use, ear-piercing cartridges may be transported and stored in a sterile condition until ready for use. It is yet another object of the present invention to provide a sterilizable and sterile stackable packing boxes that facilitates engagement and disengagement by an earring cartridge with a stud gun and which earring cartridge is resistant to reuse to ensure that the same is not reused.

It is an additional object of the present invention to provide a hand-held stud gun that can engage the earring cartridge of the invention to better control the cartridge during the ear-piercing process.

These and other objects and advantages of the present invention will be apparent from a review of the following specification and accompanying drawings.

BRIEF DESCRIPTION OF THE DRAWINGS

Referring now to the drawings in which like reference numbers represent corresponding parts throughout.

DETAILED DESCRIPTION OF THE PREFERRED EMBODIMENT

Figure 1B:
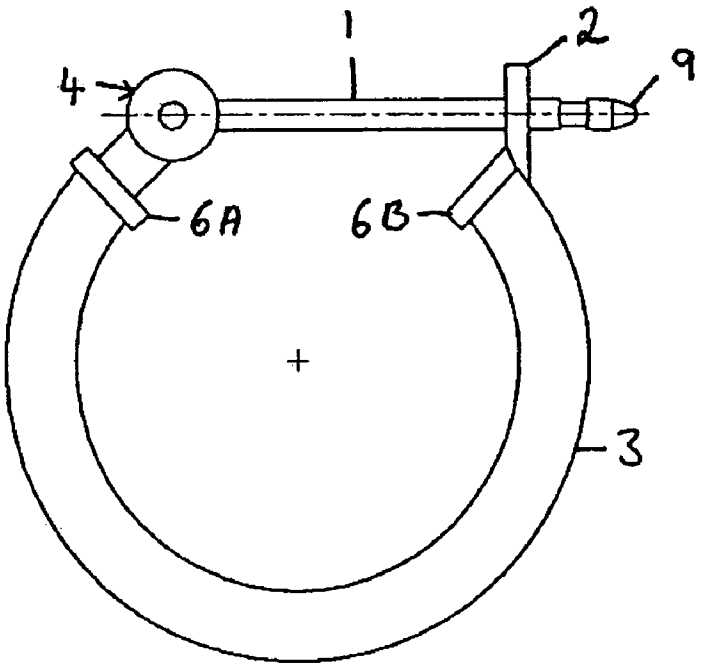
FIG. 1 presents four views of the hinged hoop earring.
Figure 1A:
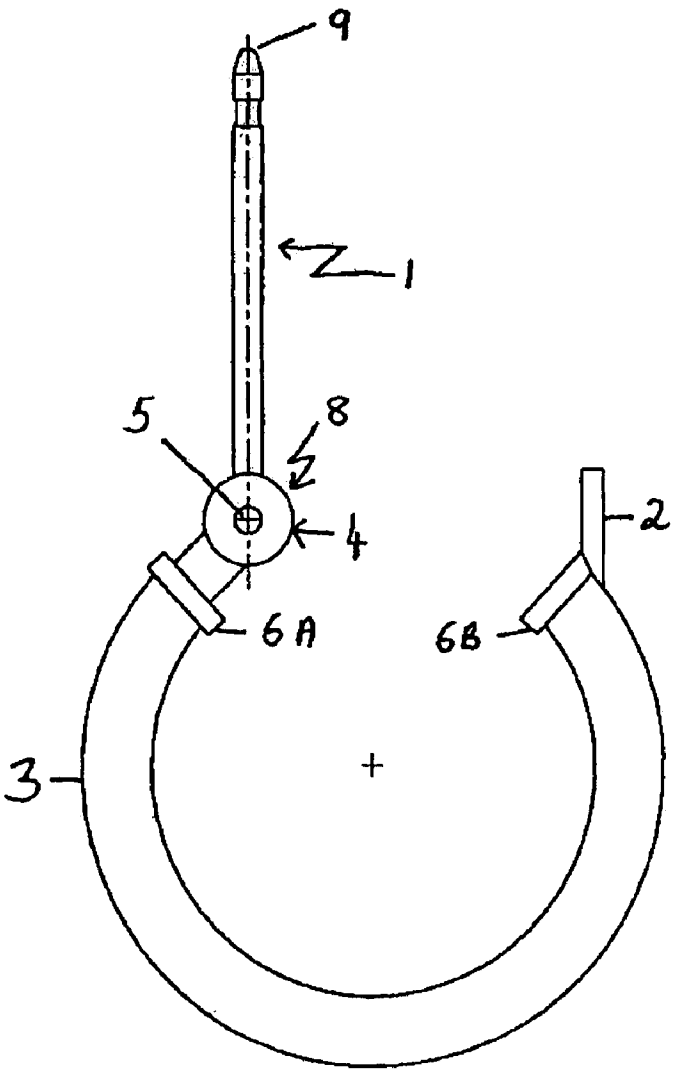
Figure 2B:
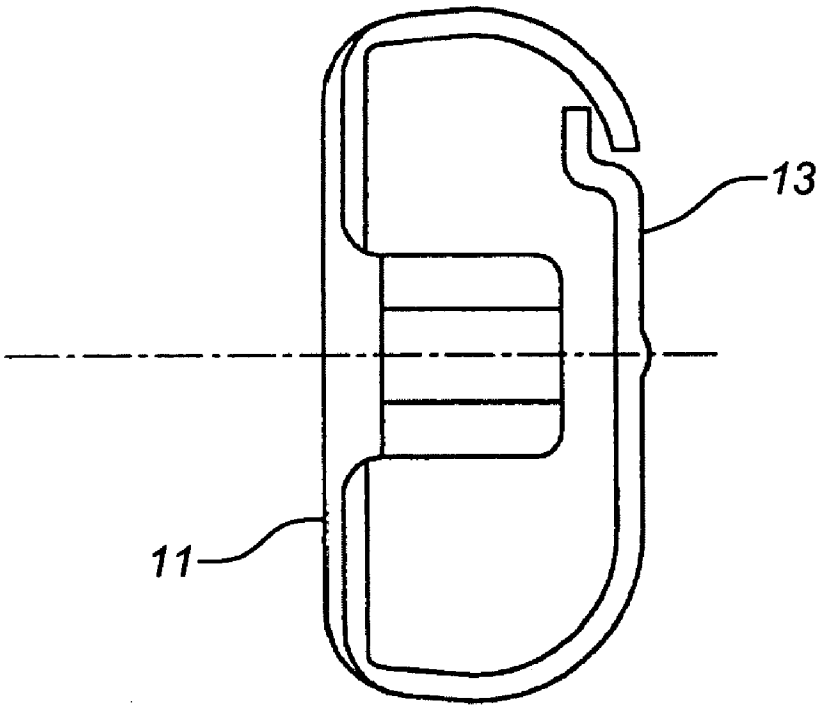
FIG. 2 presents two elevations views of the safety clasp of the invention.
Figure 2A:
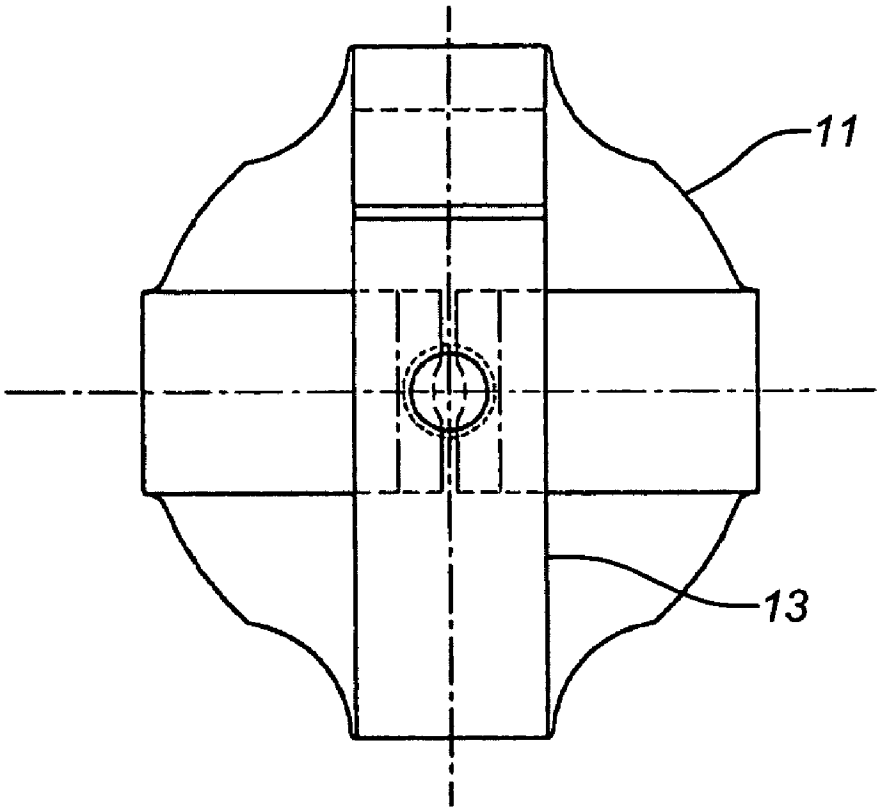
Figure 3:
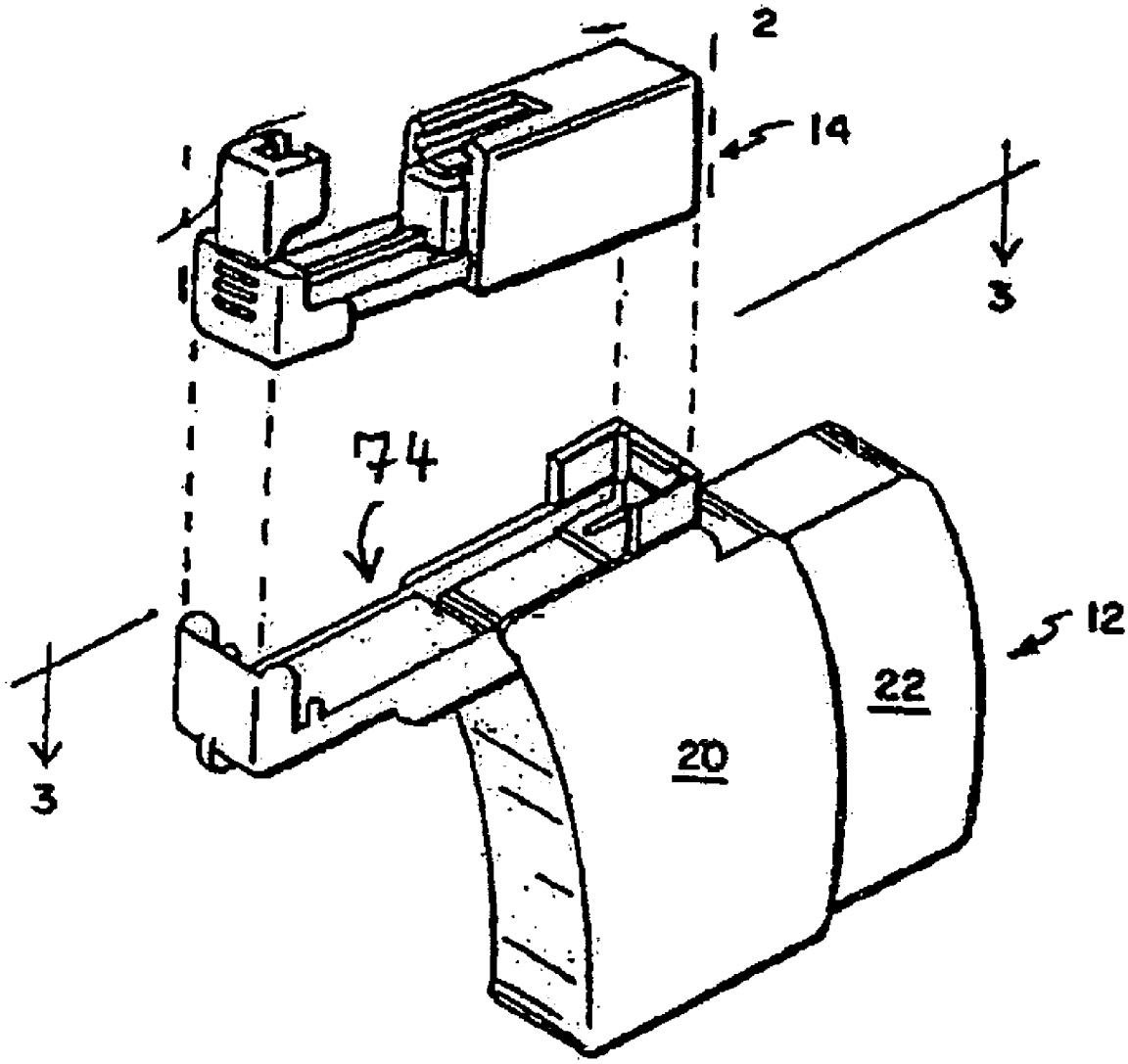
FIG. 3 is an exploded perspective view of the ear-piercing system of the present invention.

Generally, the figures show the construction and operation of the ear-piercing system of the present invention. Referring to FIG. 1A, the hinged hoop earring of the present invention is comprised of a stud hoop 3 that has a first terminal 6A and a second terminal 6B. The hinged hoop earring is further comprised of stud post 1 that has a first pointed end 9 and a second end 8 that encloses a hole 5, a hinge 4 attached to the first terminal 6A of the stud hoop 3 and a latch 2 attached to the second terminal 6B of stud hoop 3. As shown in FIG. 1C, latch 2 is a U-shaped member that is adapted to receive stud post 1, which snaps into place when it is pushed into latch 2. The distance between the two arms of latch 2 is somewhat less than the diameter of stud post 1 but the arms flex when stud post 1 is pushed through them, which causes stud post 1 to snap into its resting position. The hinged hoop earring is shown in the open position in FIG. 1A and in a dosed position in FIG. 1B. To go from the open to the closed position, latch 2 and stud post 1 are rotatably moved relative to each other around hinge 4 until stud post 1 snaps into latch 2. FIG. 2 provides further details of hinge 4. Referring to FIG. 1D, hinge 4 is comprised of two substantially flat vertical members 10. The second end 8 of stud post 1 is hinged between vertical members 10 by a pivot pin 7 that is received through hole 5 of stud post 1 and attached at either end to the vertical members 10 whereby stud post 1 and stud hoop 3 are free to rotate around the axis of pivot pin 7.

Referring to FIG. 2 earring nut (or clasp) of the invention comprises a front plate 11 that contains a hole sizeably adapted to receive stud post 1 and a shield 13 aligned with the hole in the front plate such that shield 13 forms an intervening surface between open end 9 of stud post 1 and the earring wearer. Shield 13 also prevents the nut from sliding along the stud post towards the ear, thereby maintaining enough distance between the nut and the ear to promote healing. The earring nut is for use with traditional ear-piercing earrings.

Referring to FIGS. 3–8, the earring-cartridge-and-stud gun system of the present invention is comprised of earring-cartridge stud gun 12, and earring cartridge 14 that is preferably adaptable to fit in the cradle of stud gun 12. FIG. 4A depicts a vertical section through earring cartridge 14 that is loaded with a stud P and a nut N. When used with traditional-style ear-piercing earrings, nut N is generally a metallic component that may have an ornamental purpose. In this case the nut usually is left on the stud post after the ear-piercing process is completed. However, when used with hinged hoop earrings, nut N is a disposable nut usually made of a plastic material or the like. Once a subject's ear is pierced with a hinged hoop earring, the stud hoop is swung around the ear and the stud post is snapped into the latch. The disposable nut is then removed from the stud post.

Initially, stud P is fitted within a stud post holder assembly 116, which is then fitted within earring cartridge 14. Earring cartridge 14 fits within cradle 74 of earring-cartridge stud gun 12 so that a person's entire hand, not just the fingers, may be used to wield and control the pierced-ear earring prior to and during the ear-piercing process. The cartridge is also provided with a plurality of ribs 180, 181 on its outside surface so that the cartridge itself may be used without the stud gun for ear piercing, if so desired.

Figure 4A:
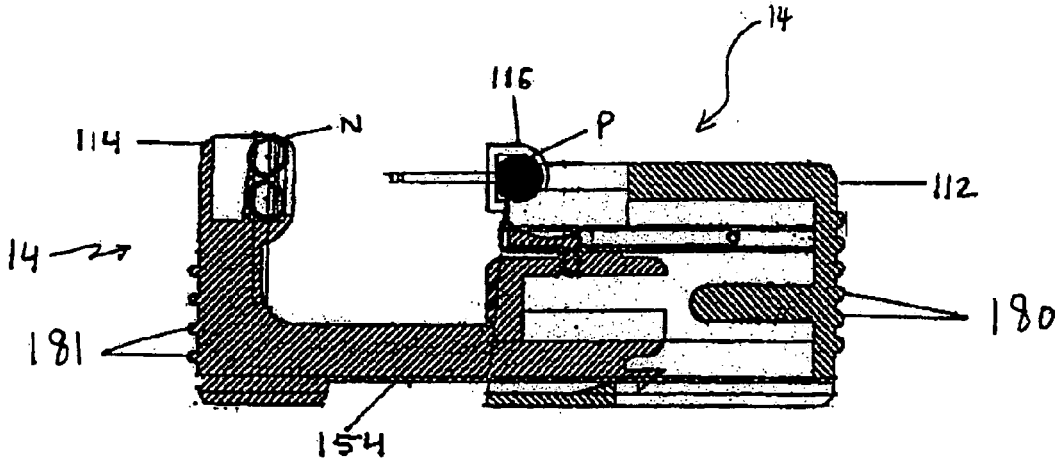
FIG. 4A is a side cross-sectional view of the ear-piercing cartridge.
Figure 4B:
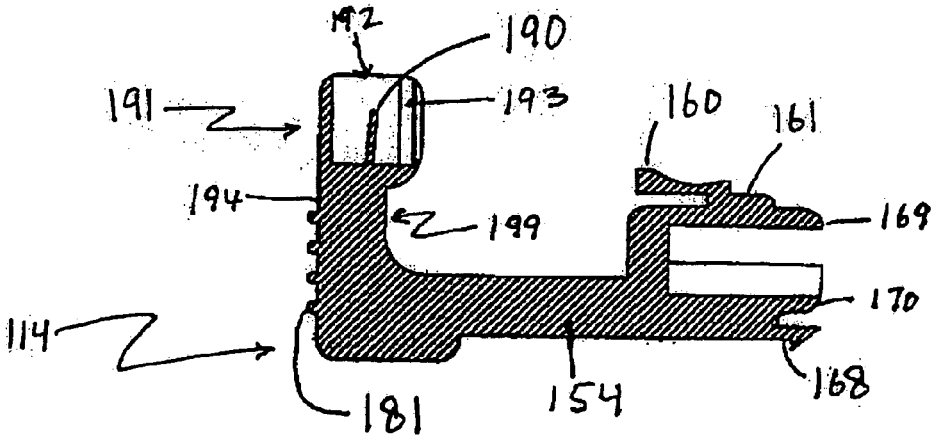
FIG. 4B is a side cross-sectional view of nut jaw.

As shown in FIG. 4A, generally, earring cartridge 14 comprises a stud post holder assembly 116 for holding stud P, an earring jaw 112 for movably carrying stud post holder assembly 116, and a nut jaw 114 for alignedly holding nut N opposite stud P, nut jaw 114 having a nut jaw extension 154 for slidably engaging nut jaw 114 with earring jaw 112. The two slidably connected portions of earring cartridge 14, nut jaw 114 and earring jaw 112, are also shown in FIGS. 4B and 5, respectively. Nut jaw extension 154 and stud post holder assembly 116 interact to produce a torque-like force on the stud post holder assembly 116 causing it to rotatably open after earring cartridge 14 is compressed to bring earring jaw 112 towards nut jaw 114, engaging post P with nut N.

Referring to FIGS. 5–6, stud post holder assembly 116 for holding the stud is in two halves, 113, 115 each half comprising main body 121, 123, front stud head adaptors 117, 119 attached to the front side of the body and L-shaped terminal members with legs 125, 127 and bases 204, 205 attached to the rear side of the body 121, 123. Front stud head adaptors 117, 119 are recessed to receive, in one embodiment, the stud head or, in another embodiment, the hinge of the hinged hoop earring.

Figure 12A:
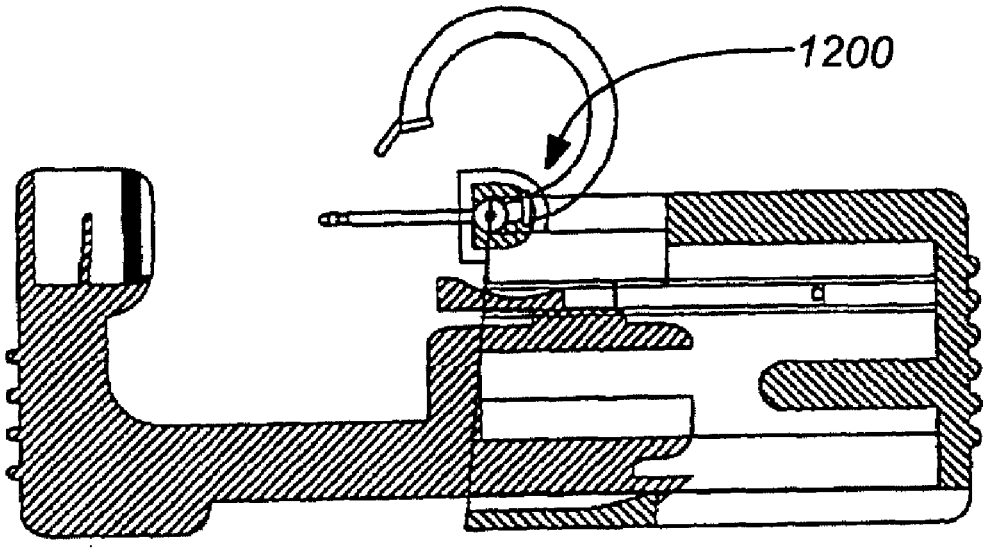
FIGS. 12A and 12B show two alignments of a hinged hoop earring.
Figure 12B:
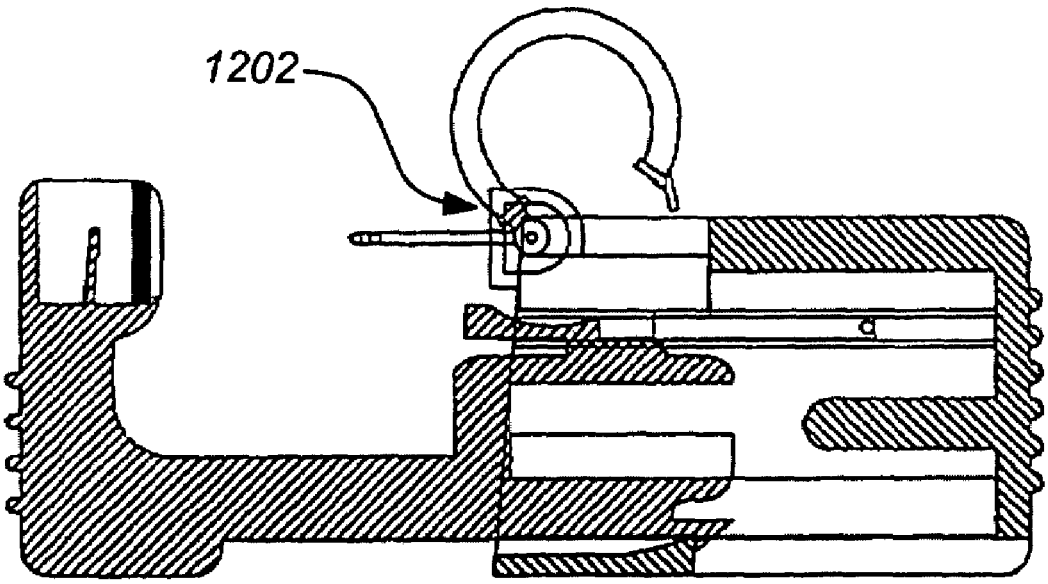

Stud post holder assembly 116 may be modified to accommodate the hinged hoop earring by making a through hole 1200, 1202 in the stud post holder assembly, adaptably sized to hold a hinged hoop earring stud (FIGS. 12A and 12B, respectively). In one embodiment, when the stud post holder assembly is used with a hinged hoop earring, it may not include the front stud head adaptor. In a preferred embodiment, when the stud head adaptors are included for use with hinged hoop earrings, they are recessed to receive the hinge of the hinged hoop earring. Further, the top surface of the earring jaw can be provided with a radial cavity such that a stud post holder assembly carrying a hinged hoop can be accommodated in it. Enough room is provided so that a hinged hoop earring can be held within the stud post holder assembly such that the hoop can curve away from the stud (FIG. 12B) or, in an alternative arrangement, curve towards the stud (FIG. 12A).

Figure 5B:
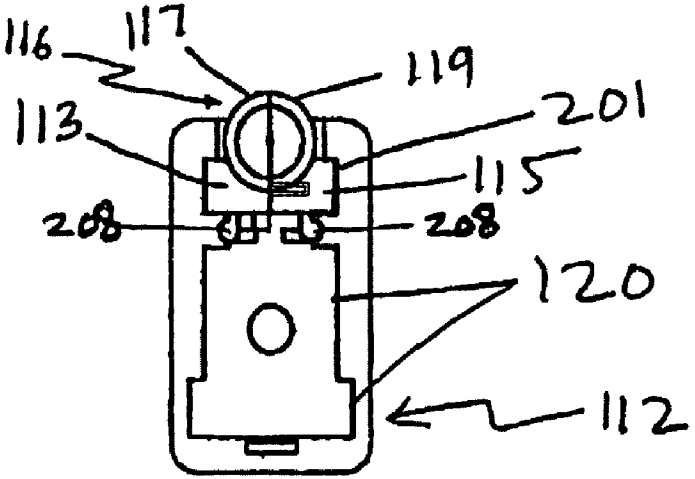
FIG. 5B is a front cross-sectional view of the earring jaw and stud post holder assembly.

As shown in FIGS. 5 and 6, stud post holder assembly 116 fits within a top channel 201 of earring jaw 112. The body of each half of stud post holder assembly 116 is held within the top channel such that stud post holder assembly 116 can slide in and out of earring jaw 112. A bottom channel 120 within earring jaw 112 is adapted for slidably engaging nut jaw extension 154 (see FIG. 5B). Bottom channel 120 with its base 152 serves as a guidance and alignment means for nut jaw extension 154.

Earring jaw 112 further comprises a nut jaw retention system comprising a bottom side 152 of earring jaw 112 adjacent the bottom channel and defining an opening 155 between an interior and an exterior of earring jaw 112. Qpening 155 is parallel to a length of the bottom side and extends from a rear portion of earring jaw 112 to a point just past a midpoint between the rear portion and a front portion of earring jaw 112 and accommodates an extending tongue 168 with a hook coupled to nut jaw 114. When tongue 168 is introduced into opening 155 the hook may travel along opening 155 and maybe caught at a forward end thereof at the point just past the midpoint.

Earring jaw 112 also comprises a biasing engagement mechanism for engaging earring jaw 112 and nut jaw 114 that tends to urge earring jaw 112 away from nut jaw 114. In the embodiment shown in FIG. 5A, the mechanism comprises a spring post 140 which is coupled centrally to an interior rear wall of the bottom channel, and extends into the bottom channel generally parallel to a bottom side approximately one-quarter the distance between a rear and a front of earring jaw 112. A spring is disposed around the spring post 140.

Additionally, earring jaw 112 comprises a plurality of ribs 180, which are present on an exterior of earring jaw 112, generally opposite the bottom channel, ribs 180 providing means by which secure manual engagement may be made of the exterior of earring jaw 112.

Nut jaw 114 optionally comprises nut holding means for holding a nut corresponding to an earring post in alignment with earring post, extension means for extending the nut holding means away from earring jaw 112 and slidable engagement means for slidably engaging earring jaw 112, the slidable engagement means coupled to the extension means. As shown in FIG. 4B, in a preferred embodiment, the nut holding means further comprise a nut holder 191 and support means 199 for supporting the nut holder in a spaced apart relationship with extension means 154. Further, nut holder 191 may define first and second nut grooves within which an earring nut N may fit. The first nut groove 192 is perpendicular to second nut groove 193; and a finger 190, rises up from the floor of block 191 in the first groove, which is capable of engaging with slight compression a nut fitted in the first and second nut grooves whereby the nut may be securely held in place by finger 190 in the first and second grooves of the block yet easily disengaged from the block.

Also, support means 199 for supporting the nut holder may comprise an upright portion 194 supporting the block away from extension means 154 whereby a void is defined between the upright portion, the extension means, and earring jaw 112 to provide room for an ear, the upright portion having a width approximately the same as the width of earring jaw 112 to provide means by which nut jaw 114 may be manually engaged.

As with earring jaw 112, a plurality of ribs 181 is present on an outward facing portion of upright portion 194 opposite the void, and provides means by which secure manual engagement 15 may be made of the exterior of nut jaw 114.

The extension means comprise a base portion which is coupled to the nut holding means. The base portion has a width approximately the same as the width of earring jaw 112 to provide means by which the nut holding means may be sturdily supported and provides a means by which nut jaw 114 may be engaged by earring jaw 112 thereby obstructing further slidable travel of nut jaw 114 into earring jaw 112. Further, a neck portion is coupled to the base portion and has a width approximately the same as the width of bottom channel 120 so that the neck portion may slide into bottom channel 120. The extension means may further comprise a tongue portion 168, which extends from the neck portion and terminates in a hook. Tongue portion 168 descends at an angle from the neck portion whereby the catch may engage a terminal end of opening 155 present in a bottom side of earring jaw 112.

In one embodiment, the slideable engagement means comprise an elongated portion slidably engaging the interior of the bottom channel. The elongated portion may define a bore wherein the bore is defined by first and second nut jaw extension 169, 170, first nut jaw extension 169 defining the upper part of the bore and the second nut jaw extension 170 defining the lower part of the bore. The first and second nut jaw extension 169, 170 have oppositely opposed curved sections that serve to retain the biasing means within the bore and that serve to define corresponding gaps between the first and second nut jaw extension 169, 170 and wherein the biasing means is a spring (not shown).

Referring to FIG. 4B, nut jaw 114 also comprises a flexible tang 160 and a hump 161 juxtaposed with flexible tang 160 such that when the rear end of the body of stud post holder assembly 116 is located ahead of the front of the flexible tang 160, bases 204, 205 of the terminal members are forced up onto hump 161. The rear end of the body of the stud post holder assembly is the end that has the terminal members attached to it. The front of the tang is the end of the tang that is closest to the nut jaw in the assembled configuration of the earring cartridge.

In one embodiment, the length of flexible tang 160 is shorter than that of legs 125, 127 of the terminal members. Additionally, in a preferred embodiment, flexible tang 160 is moldably attached to the hump 161. Further, hump 161 may be attached to the upper surface of nut jaw extension 169. As can be seen in FIG. 4B, the invention also provides that flexible tang 160 is flared upward to engage the underside of post holder assembly 116 pushing up on said assembly in a spring-like fashion. The engagement of tang 160 with post holder assembly 116 causes relative movement between assembly 116 and the earring jaw, causing body parts 121, 123 (FIG. 6B) to slide out of the earring jaw after the ear is pierced. This allows the assembly 116 to open once assembly 116 moves past tang 160 because until the body parts of the assembly move out of the earring jaw, the two halves of the assembly are constrained together, holding the stud in place. Even when tang 160 is absent, the engagement of nut N with stud P causes relative movement between assembly 116 and the earring jaw causing body parts 121, 123 (FIG. 7B) to slide out of the earring jaw after the ear is pierced and the nut is engaged by the stud.

Figure 5A:
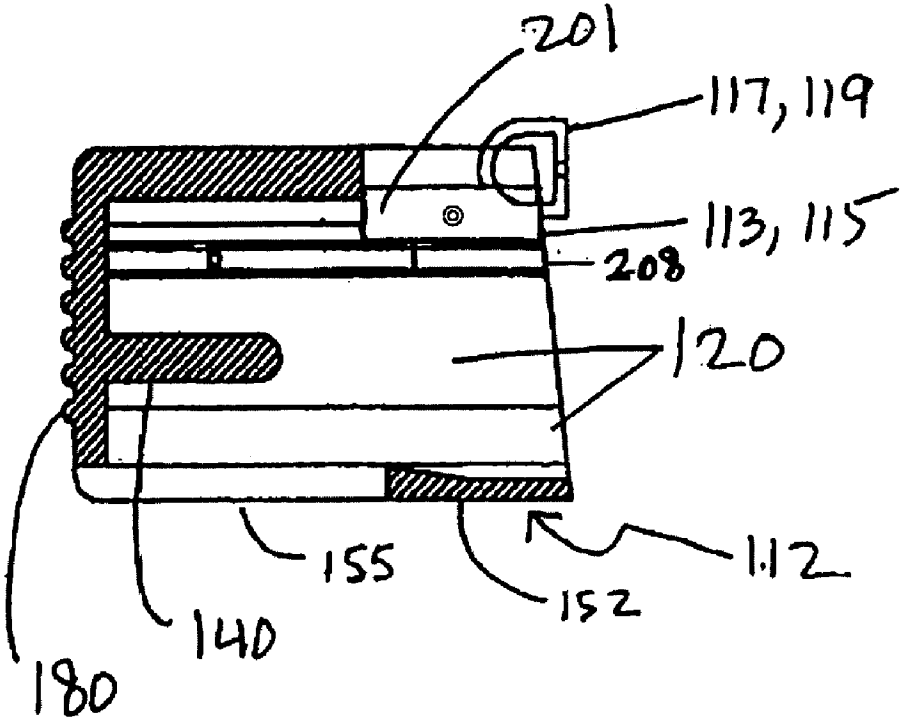
FIG. 5A is a side cross-sectional view of the earring jaw with the stud post holder assembly.

Referring to FIGS. 5A and 5B, earring jaw 112 may further comprise two intermediate channels 208 configured to adaptably receive legs 125, 127 of the terminal member of each half of stud post holder assembly 116 whereby the legs slide within intermediate channels 208 when stud post holder assembly 116 slides in and out of earring jaw 112.

A preferred embodiment of the invention provides a peg and hole alignment system for the two halves of stud post holder assembly 116 comprising a peg jutting out of the outer surface of one body and the other body having a cavity sized to adaptably receive the peg such that when the two halves of stud post holder assembly 116 are assembled together in alignment the peg is received within the cavity.

Figure 6A:
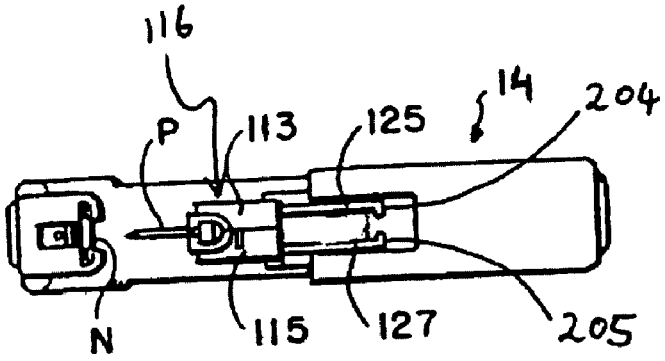
FIG. 6A presents a top view of the earring cartridge as the stud is being driven toward the clutch.
Figure 6B:
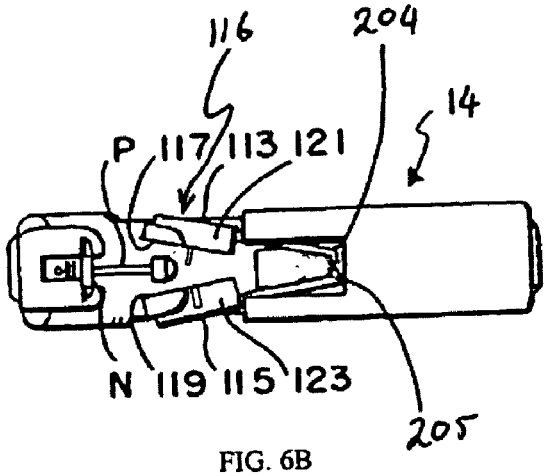
FIG. 6B shows the stud engaged with the clutch.
Figure 6C:
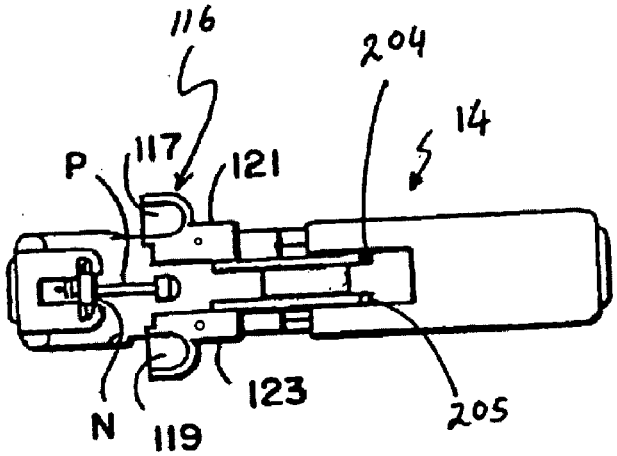
FIG. 6C shows the sequential action of the stud post holder assembly opening up to release the stud.

The operation of the earring cartridge can be understood by reference to FIGS. 6A–6C. Normally, the earring cartridge spring or other biasing means forces the nut jaw away from the earring jaw as far as the bottom slot and the hooked tongue will allow. Ample room is provided between the nut jaw and the earring jaw for the insertion of an ear to be pierced. Once the ear is placed between the nut jaw and the earring jaw, and necessarily between earring stud or post P and earring nut N, earring cartridge 14 is compressed manually or for example, by squeezing an earring cartridge stud gun, described below, within which the earring cartridge can be placed. The compression of earring cartridge 14 brings the base of L-shaped terminal members 203 over the hump causing a torque-like force to be applied on the two halves of stud post holder assembly 116.

At this point, if the ear piercer is satisfied and ready to pierce the ear, he firmly squeezes earring cartridge 14 (or the stud gun) causing the flexible tang to move past the back end of assembly 116, which leaves the flexible tang free to rise up and above the plane of the post holder assembly bottom. This drives earring stud or post P through the ear and into the flanged aperture and through the earring nut. In so doing, the elongated portion of the nut jaw compresses the earring cartridge spring and travels to the rear of the earring jaw.

During this operation, stud post holder assembly 116 is held in place, the flexible tang (moving with the elongated nut jaw portion) moves along the bottom side of stud post holder assembly 116 until it finally reaches the back end of stud post holder assembly 116.

Upon full compression of earring cartridge 14, the ear has been pierced; and earring post P has engaged nut N. Pressure is then released from the hand upon earring-cartridge 14 (or upon the earring-cartridge stud gun), pierced-ear earring cartridge halves 113 and 115 open up away from pierced-ear earring E, pierced-ear earring nut N is disengaged from nut jaw 114, the ear has been pierced, and the earring-cartridge stud gun with earring cartridge 14 may then be removed from the area adjacent the pierced ear. Because of termini portions 125 and 127 being retained, as seen in FIG. 6C, stud-holder halves 113 and 115 do not fall away, and preclude reloading of the cartridge to negate sterility. That is, the right-angle protuberances at the ends of termini portions 125 and 127 captively retain cartridge halves 113 and 115 to prevent reloading of a stud and reuse of the earring cartridge.

Figure 7:
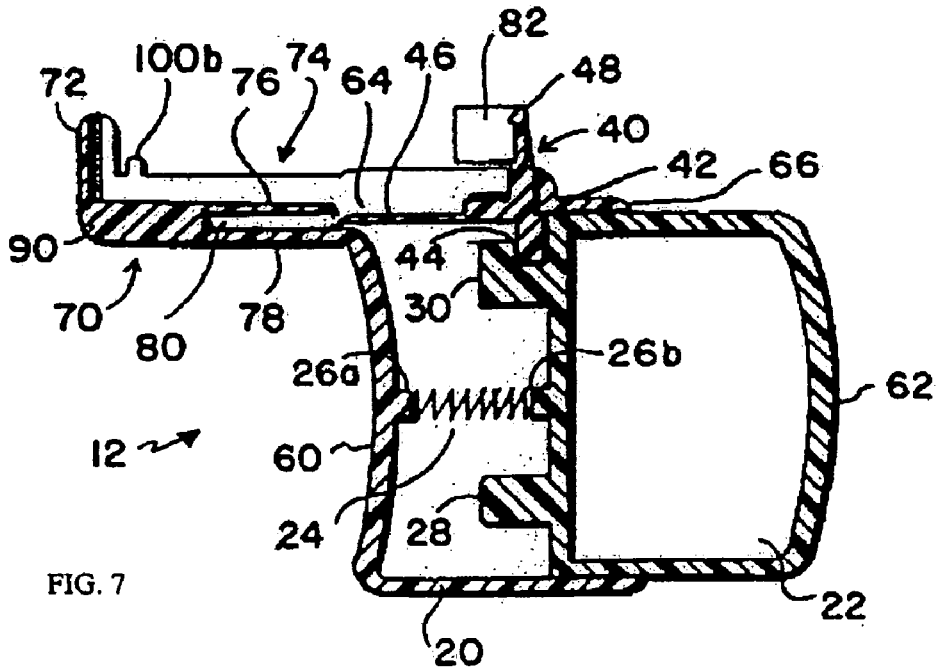
FIG. 7 is a side cross-sectional view of a stud gun.
Figure 8:
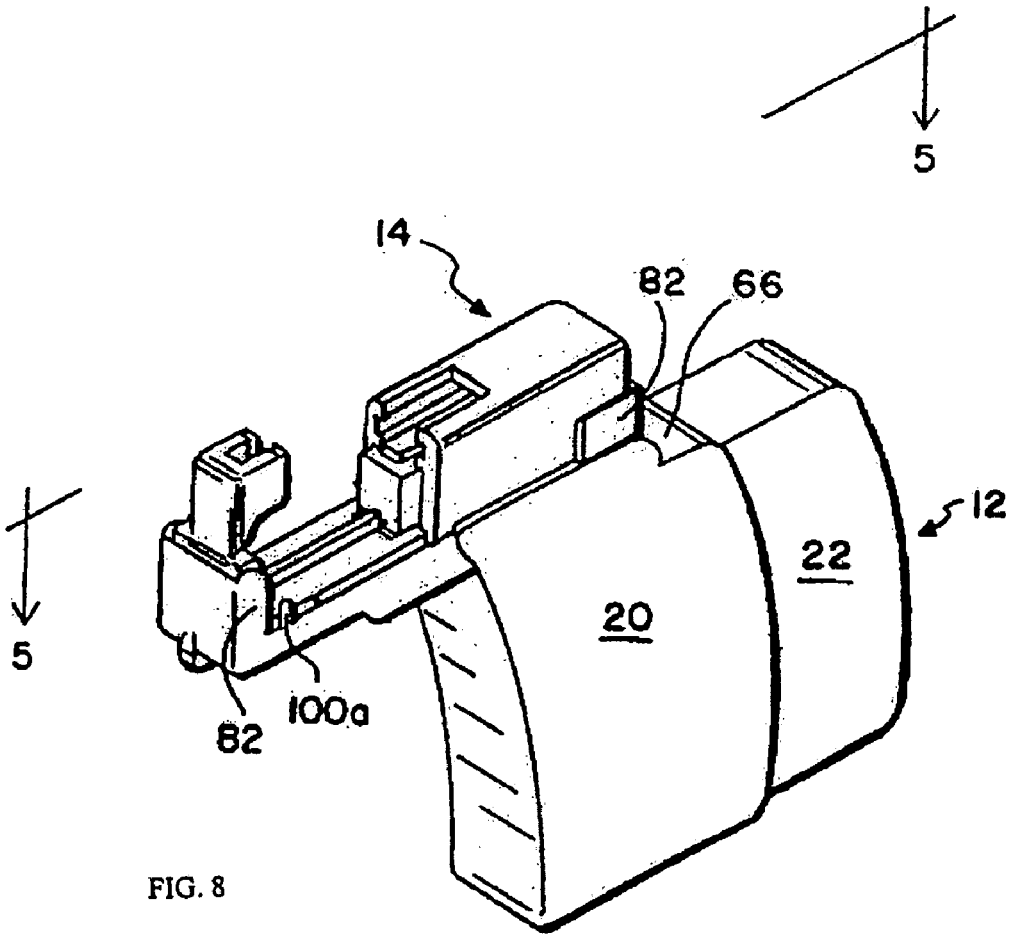
FIG. 8 is a three dimensional view of a stud gun loaded with an earring cartridge.

The earring-cartridge stud gun 12 is shown in FIGS. 7–8 and fully described in U.S. Pat. No. 5,868,774 but is also described here for the sake of completeness. FIGS. 7 and 8 show that two inter-fitting portions comprise earring-cartridge stud gun 12: grip 20 and plunger 22. Plunger 22 fits within grip 20 and slidably travels there-through, a generally short distance, namely, that distance necessary to pierce the ear with the stud portion of the pierced-ear earring. That distance of travel is approximately one-half inch and plunger 22 is easily controlled by the hand of the operator. The length of the plunger-grip assembly is approximately two-and-one-half inches taken along line 5—5 shown in FIG. 8.

As shown in FIG. 7, plunger 22 is biased by biasing means, such as spring 24, away from grip 20. Oppositely disposed stud-gun spring posts 26*a, b* serve to hold spring 24 in place between grip 20 and plunger 22 in a normally-opposed position. Plunger 22 is held in captive association with grip 20 as set forth in more detail below.

Plunger 22 may be hollow in order to conserve cost, weight and to allow for greater ease of manufacturing. On the inside of plunger 22 within grip 20, lower abutment stop 28 and an upper abutment stop 30 serve to limit the forward travel of plunger 22 into the interior of grip 20. The distance between the contact surfaces of abutment stops 28, 30, and grip 20 is approximately one-half inch. Abutment stops 28, 30 maybe formed of the same material as plunger 22 and may be molded as an integral unit with plunger 22.

Upper abutment stop 30 is formed in, an L-shape (in cross section) so as to accommodate traveling portion 40 of cradle 74 provided by earring-cartridge stud gun 12 for earring cartridge 14. Traveling portion 40 has a depending projection 42 that fits within notch 44 provided between upper abutment stop 30 and plunger 22. Tongue 46 projects laterally forward and away from plunger 22 to act as an additional travel limiting stop as will be seen. A cradle backstop 48 serves to provide the retaining support and abutment at the back of earring cartridge 14 once it is fitted into earring-cartridge stud gun 12 and more specifically, cradle 74 thereof.

Traveling portion 40 is molded as one piece with plunger 22 or may be welded thereto so as to be integral with plunger 22. Traveling portion 40 travels with plunger 22 due to its connection with upper abutment stop 30 via depending portion 42. Along with plunger 22, traveling portion 40 slidably travels along any surface of grip 20 with which it may come into contact except where abutment occurs.

Grip portion 20 has a front-curved surface 60 adapted to fit against the fingers of the hand. In conjunction with rear-curved surface 62 of plunger 22, the portion of earring cartridge stud gun 12 engaged by a person's hand fits comfortably within the hand due to complementary curved surfaces 60, 62. Grip portion 20 is approximately two inches in height, about three inches in overall width, and defines upper slot 64 through which cradle backstop 48 travels. An abutment or end wall 66 of slot 64 of grip portion 20 serves to prevent the rearward travel of cradle backstop 48 beyond that shown. Abutment 66 between cradle backstop 48 holds plunger 22 in sliding association with grip 20, even though biasing means 24 normally urges them apart.

Projecting forwardly from the top of grip 20 is a cradle extension 70 that terminates in a cradle forestop 72. The area defined between cradle forestop 72 and cradle backstop 48 serves to define a cradle 74 within which earring cartridge 14 may fit and be telescopically compressed during the ear-piercing process. Provided beneath upper surface 76 and above lower surface 78 of cradle extension 70 is a tongue groove 80. Tongue groove 80 provides travel room for tongue 46 as it travels forward. As tongue 46 is captively retained between upper surface 76 and lower surface 78 of cradle extension 70, greater stability and alignment is provided during the ear-piercing process as cradle 74 maintains its relative geometry and shape during the piercing process.

In order to provide additional support to cradle extension 70, integrally molded cradle extension support 90 extends forward of tongue groove 80 and terminates below forestop 72. Cradle extension support 90 provides additional support to cradle extension 70.

The interior of cradle 74 has additional means by which earring cartridge 14 is held and maintained in position. Thus, oppositely disposed across cradle 74 adjacent forestop 72 are two side supports 100*a, b*. Cradle side supports 100*a, b* project upwardly approximately an eighth of an inch and provide additional side securement and positioning for earring cartridge 14. The interior of backstop 48 and forestop 72 may have notches or ridges by which to engage ribs 180, 181 present on earring cartridge 14. In one embodiment, a small extension or finger (not shown) may extend upwardly from upper surface 76 of cradle extension 70 adjacent forestop 72 to frictionally engage the front end of earring cartridge 14. Both backstop 48 and forestop 72 may have side flange projections 82 to better engage and secure earring cartridge 14 in cradle 74.

The earring-cartridge and the earring-cartridge stud gun may be made of lightweight but durable plastics that are easily formed into the appropriate shapes for use as set forth above. In preferred embodiments, the stud gun and/or the cartridge may be made from one or more plastic materials including, but not limited to, the following materials: polyester, polycarbonate, paper, foil, polyimide, polyethylene, polyvinyl chloride, polystyrene, and acrylomitrite-butadiene-styrene (ABS) polymers. Alternatively, the stud gun and/or the cartridge may be made from non-plastic materials such as metal or paper.

Figure 9:
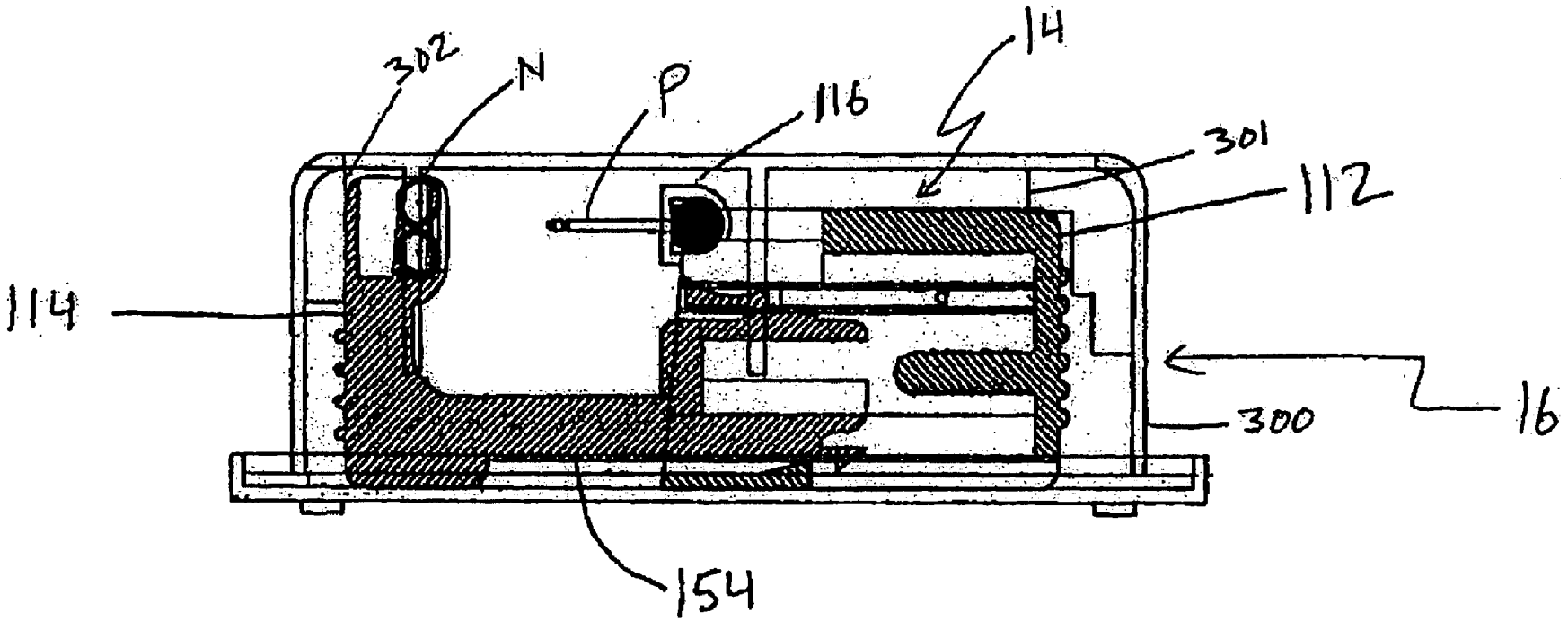
FIG. 9 is a side cross-sectional view of an earring cartridge inside a stackable packing box.

Referring to FIG. 9, earring cartridge 14 with earring stud P and nut N fits within stackable box 16. Earring-cartridge box 16 is a sealable container within which earring cartridge 14 and pierced-ear earring (N and P) may be transported and stored until ready for use. Box 16 allows and maintains sterilization of earring cartridge 14, and pierced-ear earring (N and P).

As shown in FIG. 9, earring cartridge box 16 is constructed to conform to the top of earring cartridge 14. Conforming top 300 of box 16 conforms to the top exterior of earring cartridge 14 for a close but not constricting fit. Internal indentations 301, 302 provide gripping means by which top 300 grips earring cartridge 14 inside. As earring cartridge 14 may take a variety of shapes, including shapes that accommodate hinged hoops, the shape achieved by conforming top 300 of box 16 may also take the same variety of shapes in order to accommodate earring cartridge 14.

Figure 10A:
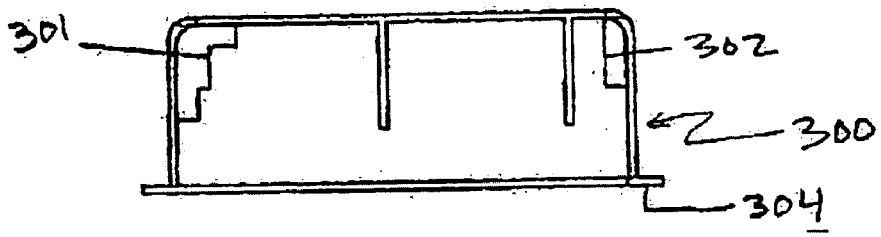
FIGS. 10A and 10B are the plan and elevation views of the packing box lid.
Figure 10B:
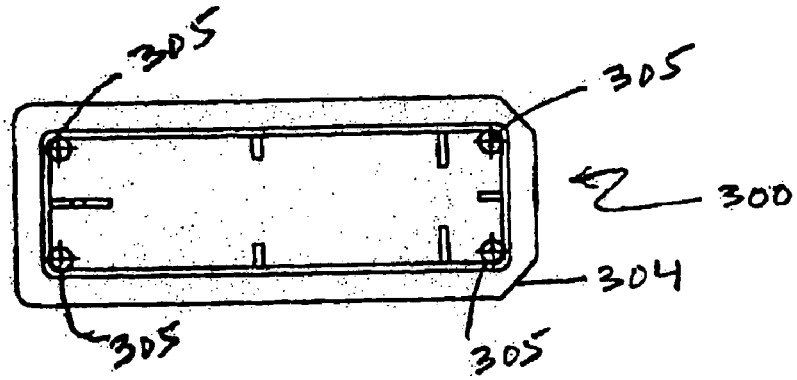

The plan and elevation views of conforming top 300 are shown in FIGS. 10A and 10B, respectively. The packing box design allows the cradle of the earring-cartridge stud gun to fit within box 16 past flange 304. This allows the earring-cartridge stud gun to engage earring cartridge 14 and remove it from box 16. This provides means by which the sterile nature of earring cartridge 14 and pierced-ear earring (N and P) may be maintained once the seal on earring-cartridge box 16 has been broken. Additionally, earring cartridge 14 may be reinserted back into box 16 after the ear-piercing process has been performed by fitting earring-cartridge box 16 over earring cartridge 14 and removing earring cartridge 14 from the cradle of the earring-cartridge stud gun.

During manufacture and prior distribution, earring cartridge 14 is fitted with a pierced ear earring (N and P) within a stud post holder assembly 116. The earring cartridge is then fitted within conforming top 300 of earring cartridge box 16. The bottom of earring cartridge 14 is above flange 304 and within the confines of box 16. Sterilizing gas or the like may be introduced into the confines of the earring-cartridge box 16 so as to sterilize its entire contents and any exposed surfaces, including earring cartridge 14 and pierced-ear earring E. Medical-grade Tyvak paper backing or the like (not shown) may be adhesively or otherwise sealingly attached to flange 304. If desired, sterilizing gas may be trapped within earring-cartridge box 16 to preserve and maintain the sterile environment previously established. Obviously, other sterilizing procedures may be used.

Figure 11A:
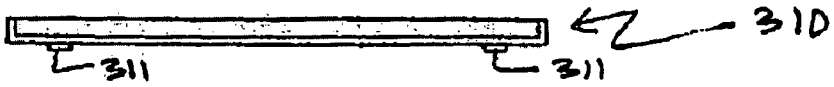
FIGS. 11A and 11B are the plan and elevation views of the packing box bottom.
Figure 11B:
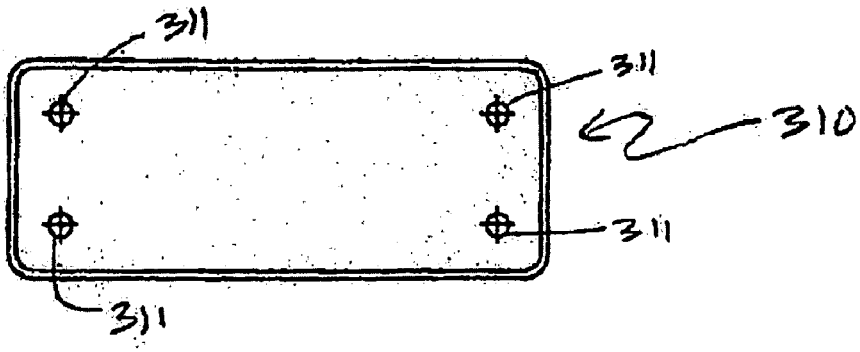

The bottom of box 16 is sealed with a lid 310, which is shown in plan and elevation views in FIGS. 11A and 11B respectively. Lid 310 snaps shut over flange 304, thereby providing protection for the paper backing used to seal conforming top 300. Lid 310 is provided with pegs 311 which can fit into corresponding holes 305 of the conforming top of another packing box. Thus, this peg and hole arrangement can be used to vertically stack the packing box on top of each other.

Once the lid is snapped onto the flange of top 300, sealed, earring-cartridge box 16 may then be transported and stored until ready for use, maintaining earring cartridge 14 and its pierced-ear earring (N and P) in a sterile condition until ready to use.

Generally, earring-cartridge packing box 16 is made of clear or other see-through plastics or materials so that earring cartridge 14 and its pierced-ear earring (N and P) may be easily visible prior to the ear-piercing process. However, it may also be made of opaque or translucent material. In preferred embodiments, the packing box may be made from one or more plastic materials including, but not limited to, the following materials: polyester, polycarbonate, paper, foil, polyimide, polyethylene, polyvinyl chloride, polystyrene, and acrylomitrite-butadiene-styrene (ABS) polymers. Alternatively, the box may be made from non-plastic materials such as metal or paper.

In operation, earring-cartridge box 16 with sterilized earring cartridge 14 is used in conjunction with the earring-cartridge stud gun as follows. Earring-cartridge box 16 is opened by snapping apart lid 310. The paper backing is then removed from its adhesive attachment with flange 304. This exposes the bottom of earring cartridge 14 and provides access to the cradle to the interior of earring-cartridge box 16. The cradle of the stud gun is then brought into the confines of earring-cartridge box 16 to engage the bottom of earring cartridge 14. Once the cradle has securely engaged earring cartridge 14, box 16 is then removed from the top of earring cartridge 14. The ear to be pierced may then be pierced by placing the ear between the nut jaw and post P of the earring E. The plunger and the grip of the stud gun are then pressed together to force the earring post into earring nut N, piercing the ear lobe, as described more fully above.

Conforming top 300 may then be re-fitted over the used earring cartridge whereby earring cartridge 14 may be engaged within top 300 and removed from cradle 74. Following that top 300 may be sealed shut by snapping its lid 310 back on. By using packing box 16, earring cartridge 14 need never be touched by human hands or other contaminating surface prior to, during, or after the ear-piercing process because the operator can load and unload the stud gun by holding the packing box, without touching the cartridge.

Thus, in the instant invention a cartridge 14 is now designed not merely as a container for the pierced-ear earring and earring Nut N, but also acts as a loading tool by which the earring-cartridge stud gun may be loaded. Moreover, cartridge 14 is stored and transported in stackable packing boxes 300, which provide sealed secure storage for the cartridge before and after use and which are adapted for convenient vertical stacking. It can be readily seen that by using the system disclosed that sterility and ease of handling for user of the system is accomplished.

While the present invention has been described with reference to particular embodiments, it is recognized that additional variations of the present invention may be devised without departing from the inventive concept as set forth in the following claims.

What is claimed is:

1. An earring cartridge, comprising:

a single hinged hoop earring; and a stud post holder assembly holding a stud post of the single hinged hoop earring in the earring cartridge, the earring cartridge for producing a single piercing with the stud post of the single hinged hoop earring;

wherein the earring cartridge can be loaded and unloaded in a cradle of a stud gun, the stud gun operating with the earring cartridge for producing the single piercing with the single hinged hoop earring, and the stud post holder assembly comprises stud head adapters recessed to receive a hinge of the single hinged hoop earring.

2. The earring cartridge of claim 1, wherein the stud gun can be loaded and unloaded using a packing box of the earring cartridge in such a way that an operator need not touch the earring cartridge during loading and unloading.

3. The earring cartridge of claim 1, wherein the earring cartridge with the single hinged hoop earring is stored in a packing box for maintaining a sterile environment.

4. The earring cartridge of claim 1, wherein the stud post holder assembly comprises a through hole adaptably sized to hold the single hinged hoop earring.

5. The earring cartridge of claim 1, further comprising an earring jaw including a radial cavity such that the stud post holder assembly carrying the single hinged hoop can be accommodated in the radial cavity.

6. The earring cartridge of claim 1, wherein a stud hoop of the single hinged hoop earring curves away from the stud post of the hinged hoop earring.

7. The earring cartridge of claim 1, wherein a stud hoop of the single hinged hoop earring curves towards a stud post of the single hinged hoop earring.

8. The earring cartridge of claim 1, further comprising a disposable nut.

9. The earring cartridge of claim 8, wherein the disposable nut comprises a plastic material.

10. The earring cartridge of claim 8, wherein the disposable nut is removed after piercing and a stud hoop of the single hinged hoop earring is swung around and a stud post of the single hinged hoop earring is snapped into a latch of the hoop.

11. The earring cartridge of claim 1, wherein the single hinged hoop earring further comprises:

a stud hoop;

a stud post having a free end and a connected end;

a hinge attached to a first end of the stud hoop, the stud post pivotally mounted on the hinge so that the connected end of the stud post is connected to the hinge; and a latch attached to a second end of the stud hoop, wherein the latch is adapted to receive a part of the stud post that is proximate to the free end of the stud post.

12. An earring cartridge, comprising:

a single hinged hoop earring; and a stud post holder means for holding a stud post of the single hinged hoop earring in the earring cartridge, the earring cartridge for producing a single piercing with the stud post of the single hinged hoop earring;

wherein the earring cartridge can be loaded and unloaded in a cradle of a stud gun, the stud gun operating with the earring cartridge for producing the single piercing with the single hinged hoop earring, and the stud post holder means comprises stud head adapters recessed to receive a hinge of the single hinged hoop earring.

13. A single hinged hoop earring, comprising:

a stud hoop;

a stud post having a free end and a connected end;

a hinge attached to a first end of the stud hoop, the stud post pivotally mounted on the hinge so that the connected end of the stud post is connected to the hinge; and a latch attached to a second end of the stud hoop, wherein the latch is adapted to receive a part of the stud post that is proximate to the free end of the stud post;

wherein the stud post is supported in a stud post holder assembly held in an earring cartridge, the earring cartridge for producing a single piercing with the stud post of the single hinged hoop earring in an ear piercing stud gun and wherein the earring cartridge can be loaded and unloaded in a cradle of a stud gun, the stud gun operating with the earring cartridge for producing the single piercing with the single hinged hoop earring, and the stud post holder assembly comprises stud head adapters recessed to receive a hinge of the single hinged hoop earring.

14. The single hinged hoop earring of claim 13, wherein the earring cartridge with the single hinged hoop earring is stored in a packing box for maintaining a sterile environment for the single hinged hoop earring.

15. The single hinged hoop earring of claim 13, wherein the earring cartridge comprises a disposable nut.

16. The single hinged hoop earring of claim 15, wherein the disposable nut comprises a plastic material.

17. The single hinged hoop earring of claim 15, wherein the disposable nut is removed after piercing and a hoop of the single hinged hoop earring is swung around and a stud post of the hinged hoop earring is snapped into a latch of the hoop.

* * * * *